United States Patent [19]

Nishikawa

[11] Patent Number: 4,484,169

[45] Date of Patent: Nov. 20, 1984

[54] TRANSFORMER APPARATUS WITH SUPERIMPOSED INSULATED SWITCH AND TRANSFORMER UNITS

[75] Inventor: Akira Nishikawa, Nara, Japan

[73] Assignee: Mitsubishi Denki Kabushiki Kaisha, Japan

[21] Appl. No.: 436,620

[22] Filed: Oct. 25, 1982

[30] Foreign Application Priority Data

Nov. 5, 1981 [JP] Japan ..... 56-178568
Nov. 5, 1981 [JP] Japan ..... 56-178569

[51] Int. Cl.[3] ..... H01F 27/10

[52] U.S. Cl. ..... 336/57; 336/58; 336/105

[58] Field of Search ..... 336/55, 57, 58, 105; 361/268; 174/14 R, 15 R

[56] References Cited

FOREIGN PATENT DOCUMENTS 552294 1/1958 Canada ..... 336/57
843579 5/1952 Fed. Rep. of Germany ..... 336/57
74113 6/1980 Japan ..... 336/105

OTHER PUBLICATIONS

Nisshin Denki Engineering, vol. 26, No. 3, 1981.

*Primary Examiner*—A. D. Pellinen
*Assistant Examiner*—Susan Steward
*Attorney, Agent, or Firm*—Leydig, Voit, Osann, Mayer and Holt, Ltd.

[57] ABSTRACT

This invention relates to improvements in a transformer apparatus in which a transformer unit insulated with insulating oil and a switch unit insulated with insulating gas are combined. The transformer unit is accommodated in a transformer tank filled with the insulating oil. The switch unit is accommodated in a switch tank filled with the insulating gas. The switch tank is disposed on the top of the transformer unit and made integral therewith such that these tanks are communicated with each other in the interior of the communicated tanks.

11 Claims, 5 Drawing Figures

TRANSFORMER APPARATUS WITH -SUPERIMPOSED INSULATED SWITCH AND TRANSFORMER UNITS

BACKGROUND OF THE INVENTION

This invention relates to a transformer apparatus comprising a transformer unit insulated with insulating oil and a switch unit insulated with an insulating gas.

In many prior art transformer apparatus, different insulating fluids are used for the switch unit and for the transformer unit. The switch unit is usually insulated with air, insulating oil, $SF_6$ gas, vacuum, etc., while the transformer unit is usually insulated with air, insulating oil, $SF_6$ gas, etc. Recently, $SF_6$ gas has been extensively used as the insulating fluid for the switch unit. On the other hand, in many cases the usual insulating oil is used as the insulating fluid for the transformer unit. For these reasons, a construction as shown in FIG. 1 is typically adopted in cases where the switch and transformer units are insulated with different insulating fluids. In the prior art transformer apparatus shown in FIG. 1, the transformer unit 5, which is insulated with sealed insulating oil 3, is disposed in a transformer tank 1A. A reservoir 12 is coupled to the transformer tank 1A. The switch unit 4 which is insulated with a sealed insulating gas 2 is disposed in a switch tank 1B. The transformer unit 5 and switch unit 4 are coupled together by a penetrating bushing 13 which provides a seal between both the tanks 1A and 1B. The switch unit 4 is connected to an aerial cable 9 through a primary side bushing 8. The transformer unit 5 is connected to an aerial side cable 11 through a secondary side bushing 10.

With the above construction, however, the penetrating bushing has a complicated and expensive construction. In addition, nitrogen ($N_2$) gas must be sealed in the interior of the reservoir. This means that excess insulating oil corresponding in quantity to the oil in the reservoir is necessary. Further, both the tanks occupy a large floor space, so that a broad installation area is required. The fact that the occupied floor space is so large is also undesirable from the stand-point of transport.

SUMMARY OF THE INVENTION

The invention has been intended in order to overcome the above drawbacks, and its object is to provide a transformer apparatus, in which a switch unit insulated with insulating gas and a transformer unit insulated with insulating oil are disposed in upper and lower portions of a tank respectively, and which thus has a simple construction and occupies a small floor space.

BRIEF DESCRIPTION OF THE DRAWINGS

In the drawings, like reference numerals and symbols designate like parts.

DESCRIPTION OF THE PREFERRED EMBODIMENTS

Figure 1:
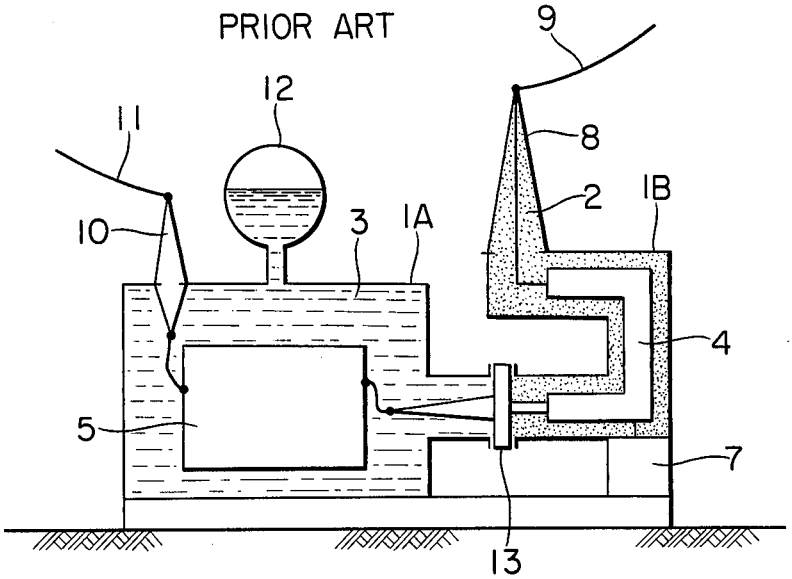
FIG. 1 PRIOR ART
FIG. 1 is an elevational sectional view showing a prior art transformer apparatus.
Figure 2:
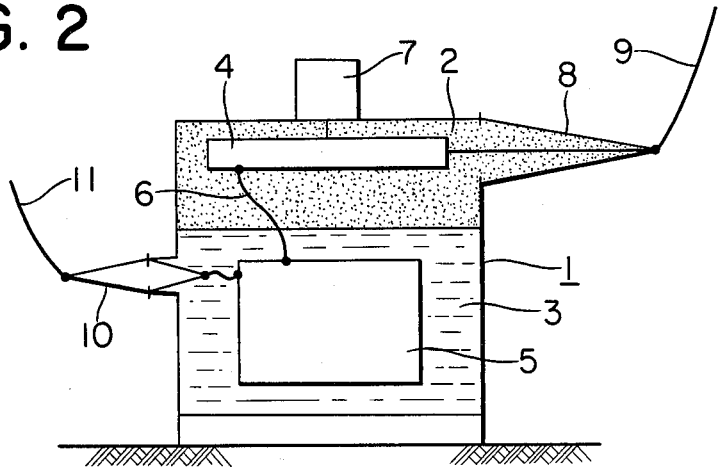
FIG. 2 is an elevational sectional view showing an embodiment of the invention.

FIG. 2 shows an embodiment of the invention. In a tank 1, insulating gas 2 is sealed in an upper portion, and insulating oil 3 is sealed in a lower portion. A switch unit 4 and a transformer unit 5 are disposed in upper and lower portions of the tank 1 respectively. The switch unit 4 and transformer unit 5 are connected together by a connecting line 6 inside the tank 1. A switch driving mechanism 7 for driving the switch unit 4 is provided on top of the tank 1. The switch unit 4 is connected to an aerial cable 9 via a primary side bushing 8. The transformer unit 5 is connected to an aerial cable 11 via a secondary side bushing 10. The bushings 8 and 10 are provided on the outer periphery of the tank 1.

With the construction of the embodiment of FIG. 2, when the temperature of the transformer unit 5 is increased during its operation, the temperature of the insulating oil 3 is also increased so that its volume is increased by thermal expansion. The volume increase of the insulating oil 3 is absorbed by corresponding compression and upward displacement of the insulating gas caused by the rising level of the insulating oil.

Figure 3:
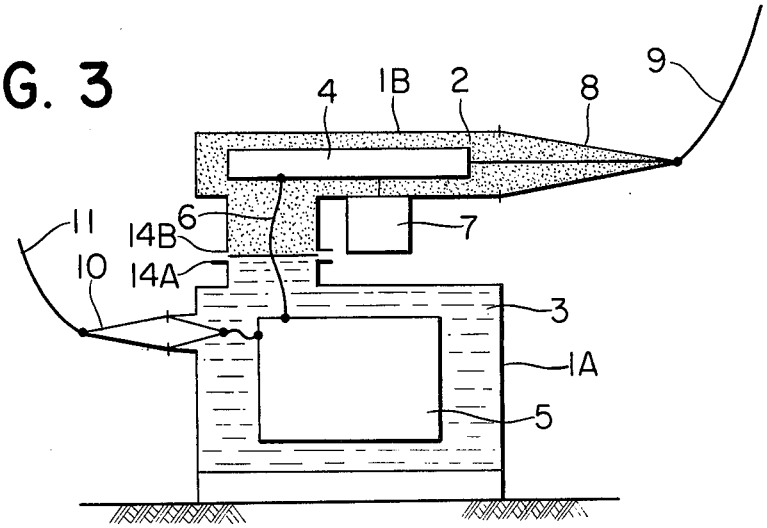
FIG. 3 is an elevational sectional view showing a different embodiment of the invention.

FIG. 3 shows a different embodiment of the invention. This embodiment comprises a transformer tank 1A and a switch tank 1B provided on the transformer tank 1A. The tanks 1A and 1B have respective outer flanges 14A and 14B which are coupled together such that the tanks 1A and 1B are communicated with each other. In this embodiment, the area of contact between the insulating gas and insulating oil can be reduced to supress chemical changes of the insulating oil. Here, the driving mechanism 7 for the switch unit 4 is provided on the outer surface of the bottom of the upper switch tank 1A to reduce the height of the apparatus.

Figure 4:
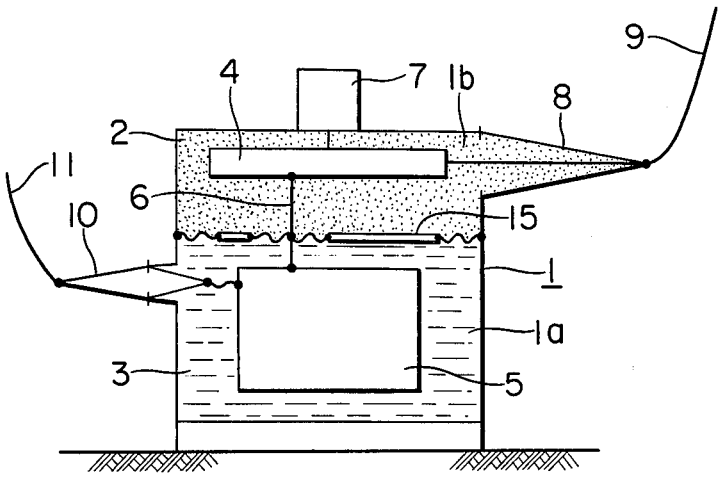
FIG. 4 is an elevational sectional view showing a further embodiment of the invention.

FIG. 4 shows a further embodiment, in which a flexible insulating partition wall is provided in the boundary between the insulating gas and insulating oil. More particularly, the interior of a tank 1 is partitioned by a flexible insulating partition wall 15 into an upper and lower section **1*b* and 1*a*. The upper section 1*b* is filled with a sealed insulating gas 2, while the lower section 1*b* is filled with sealed insulating oil 3. A switch unit 4 is disposed in the upper section 1*b*, and a transformer unit 5 is disposed in the lower section 1*a*. The switch unit 4 and transformer unit 5 are connected together by a connecting line 6 in the tank 1. The connecting line 6 penetrates the insulating partition wall 15 such that it is oil-tight and gas-tight with respect thereto. A switch driving mechanism for operating the switch unit 4 is provided on the top of the tank 1. The switch unit 4 is connected to an aerial cable 9 via a primary side bushing 8. The transformer unit 5 is connected to an aerial cable 11 via a secondary side bushing 10**.

With the above construction, when the temperature of the transformer unit 5 is increased due to energization thereof, the insulating oil 3 is thermally expanded. As a result, the insulating partition wall 15 is deformed upwardly to make up for the increase of the volume of the insulating oil 3.

Figure 5:
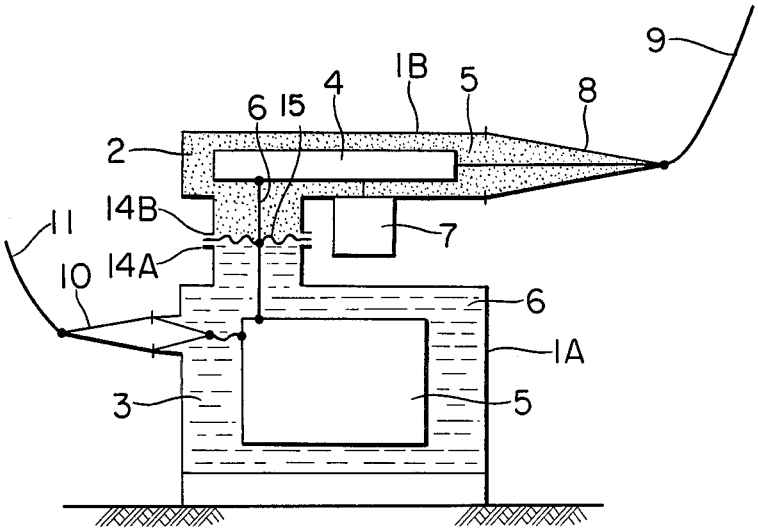
FIG. 5 is an elevational sectional view showing a still further embodiment of the invention.

FIG. 5 shows a further embodiment of the invention. Here, an upper section 1B and a lower section 1A are coupled together by respective flanges 14A and 14B, and a flexible insulating partition wall 15 is provided between the flanges 14A and 14B.

In this embodiment, since the insulating partition wall 15 is provided between the flanges 14A and 14B, its size can be reduced so that it can be more easily manufactured compared to the partion wall in case of FIG. 4. Also, a switch operating mechanism 7 for operating the switch unit 4 is provided on the outer surface of the bottom of the upper section 1B to reduce the height of the apparatus.

As has been described in the foregoing, according to the invention it is possible to greatly reduce the floor area of a transformer apparatus comprising a switch unit and a transformer unit, these units being insulated with different insulating liquids.

What is claimed is:

1. A transformer apparatus comprising a tranformer tank accommodating a transformer unit and filled with an insulating oil, and a switch tank accommodating a switch unit and filled with an insulating gas, said switch means being disposed on top of said transformer tank and made integral therewith, such that these tanks are in communication with each other along a movable boundary face between the insulating oil within said transformer tank and the insulating gas within said switch tank, thereby permitting expansion of said insulating oil into said switch tank, said switch unit and said transformer unit being connected to each other in the interior of said communicating tanks.

2. The transformer apparatus according to claim 1, wherein said transformer tank and switch tank are constituted by a single tank.

3. The transformer apparatus according to claim 1, wherein said transformer tank and switch tank have respective bushings outwardly projecting from the periphery for connection to external apparatus.

4. The transformer apparatus according to claim 1, wherein said transformer tank and switch tank have respective flange sections which are coupled together, the boundary face between said insulating oil and insulating gas being found within said flange sections.

5. The transformer apparatus according to claim 1, which further comprises a flexible insulating partition wall provided in the boundary face between the insulating oil of said transformer unit and the insulating gas of said switch unit.

6. The transformer apparatus according to claim 4, which further comprises a flexible insulating partition wall provided in the boundary face between the insulating oil and said insulating gas found in said flange sections.

7. The transformer apparatus according to claim 4, which further comprises a switch operating mechanism provided on the outer surface of the bottom of said switch tank provided on the top of said transformer tank and coupled thereto by said flange sections.

8. The transformer apparatus according to claim 5 wherein said flexible insulating partition wall forms an oil-tight and gas-tight seal separating said insulating oil and said insulating gas.

9. The transformer apparatus according to claim 6 wherein said flexible insulating partition wall forms an oil-tight and gas-tight seal separating said insulating oil and said insulating gas.

10. The transformer apparatus according to claim 1 wherein communication between said transformer tank and said switch tank is direct.

11. The transformer apparatus according to claim 1 wherein said switch unit and said transformer unit are directly connected to each other.

* * * * *